US007008294B2

(12) United States Patent
Junker

(10) Patent No.: US 7,008,294 B2
(45) Date of Patent: Mar. 7, 2006

(54) METHOD AND DEVICE FOR GRINDING A ROTATING ROLLER USING AN ELASTIC STEADY-REST SUPPORT

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 10/521,472

(22) PCT Filed: Jul. 17, 2003

(86) PCT No.: PCT/EP03/07788

§ 371 (c)(1),
(2), (4) Date: Jan. 18, 2005

(87) PCT Pub. No.: WO2004/007145

PCT Pub. Date: Jan. 22, 2004

(65) Prior Publication Data

US 2005/0239376 A1 Oct. 27, 2005

(30) Foreign Application Priority Data

Jul. 17, 2002 (DE) ..... 102 32 394

(51) Int. Cl.
*B24B 49/00* (2006.01)

(52) U.S. Cl. ..... 451/5; 451/49; 451/246; 451/407; 451/408; 451/450

(58) Field of Classification Search ..... 451/5, 451/10, 11, 49, 142, 143, 242, 246, 407, 408, 451/449, 450

See application file for complete search history.

(56) References Cited

U.S. PATENT DOCUMENTS

| | | | | |
|---|---|---|---|---|
| 3,425,168 A | | 2/1969 | Porath | |
| 3,427,762 A | | 2/1969 | Mills | |
| 3,848,370 A | * | 11/1974 | Garcin | 451/398 |
| 3,854,252 A | * | 12/1974 | Lindsay et al. | 451/408 |
| 4,485,593 A | * | 12/1984 | Munzing et al. | 451/249 |
| 4,634,323 A | * | 1/1987 | Wagner et al. | 409/167 |
| 4,663,892 A | * | 5/1987 | Smith | 451/49 |
| 4,827,673 A | * | 5/1989 | Waelti | 451/9 |

(Continued)

FOREIGN PATENT DOCUMENTS

DE 16 27 998 11/1970

(Continued)

*Primary Examiner*—Eileen P. Morgan
(74) *Attorney, Agent, or Firm*—Jordan and Hamburg LLP

(57) ABSTRACT

The invention relates to a device for grinding rollers, also for grinding hollow rollers. As the rollers tend to vibrate transversally as a result of the contact with the grinding disc, a cushioned body is applied to the opposite side of the roller from the grinding disc, said body being engaged pneumatically against the roller and adapting at least partially to the contours of the roller. The cushioned body consists of an elastic solid material or an elastic external skin that is filled with an elastic pressurized medium. The engagement pressure of the cushion is adjustable. This is achieved by a pneumatic advance cylinder located on a base, said cylinder having a piston that can be impinged on both sides and that bears on its piston rod a fixing plate comprising the elastic cushion. The advance cylinder is connected to compressed air conduits, P indicating the conduit comprising a pressure regulator and L indicating the return conduit in the standard case. The invention thus provides a device for damping vibrations, which suppresses any regenerative chatter and guarantees a grinding pattern that is devoid of chatter marks.

30 Claims, 7 Drawing Sheets

U.S. PATENT DOCUMENTS 5,213,348 A * 5/1993 Crossman et al. ..... 279/126
5,355,633 A * 10/1994 Ishikawa et al. ..... 451/5
5,527,210 A * 6/1996 Sharer ..... 451/408
5,730,647 A * 3/1998 Becker et al. ..... 451/173
5,766,059 A * 6/1998 Imai et al. ..... 451/49
6,506,103 B1 * 1/2003 Ohmori et al. ..... 451/72
6,857,947 B1 * 2/2005 Wang et al. ..... 451/296

FOREIGN PATENT DOCUMENTS

DE 15 77 369 7/1971
DE 21 63 084 6/1973

* cited by examiner

METHOD AND DEVICE FOR GRINDING A ROTATING ROLLER USING AN ELASTIC STEADY-REST SUPPORT

BACKGROUND OF THE INVENTION

The invention relates to a method and an apparatus for grinding the exterior circumference of a rotating roller, held at its ends, with a rotating grinding wheel, whereby the length of the roller is a multiple of the width of the grinding wheel.

In many large-scale and industrial production processes, long narrow rollers are required that rotate during operation, sometimes must be driven, and often must be heated or cooled from inside. Such rollers can for instance have a length of approximately 1000 mm and a diameter of 85 mm. In addition the rollers are frequently tube-shaped with a low wall thickness that can be less than 1 mm. High stresses are placed on the surface quality of these rollers and on their dimensional stability. Grinding such rollers to final dimensions and the required surface quality therefore present great challenges to one skilled in the art.

One known disadvantageous aspect when grinding the exterior of rollers is that they bend outward laterally when the grinding wheel acts on their circumferential surface. This can lead to a situation in which the finished roller deviates from the cylindrical shape. In addition, the roller begins self-starting transverse vibrations, so-called regenerative chattering. The result of this regenerative chattering is chatter marks on the circumferential surface of the roller, which can cause reduced surface quality and thereby render the resultant roller unusable for many applications.

In order to prevent rollers from bending outward during grinding, it is known to support the roller at its exterior circumference with one or a plurality of steadies or rests. The steadies or rests comprise steel supports that support the blank. However, supporting the rotating roller on the steadies or rests comprising steel frequently leads to tracks, which can also cause reduced surface quality that cannot be tolerated. Known operating measures for eliminating regenerative chattering slow the grinding process.

One type of method mentioned in the foregoing known from commercial practice is that the roller is first rough-ground in the plunging method using a grinding wheel comprising corundum. For this, the roller is processed to a rough-ground dimension such that there are a plurality of successive plunges with the grinding wheel until the entire length of the roller has been rough-ground to this dimension. Subsequently this same grinding wheel is dressed and then fine- or finish-grinding is performed. Finish-grinding is done using longitudinal grinding, whereby the rotating grinding wheel and the rotating roller are moved relative to one another in the longitudinal direction of the roller on its exterior circumference. When the length of the roller is for instance 1,000 mm, grinding wheels with a width of for instance 100 mm are used. The disadvantage of this known method is that the grinding wheels comprising corundum must be dressed. This can even become necessary during a single finish-grinding process. Overall, the known grinding method is very tedious.

Known from DE 16 27 998 A1 is a follower rest for supporting cylindrical workpieces in a grinding machine that forms a hydrostatic semi-bearing. The rotating workpiece to be ground thus rests on a film of liquid that must be continuously replenished. An uninterrupted stream of liquid is fed to the hydrostatic semi-bearing for this purpose. The liquid can be a coolant that is always necessary when grinding. This known rest was used to achieve the goal of effectively supporting the workpiece, protecting its surface, and achieving a low-friction bearing, so that the rest does not need to be changed too often. Damping vibrations and avoiding chatter marks were not objectives with the known rests and therefore are also to a large extent unattainable with them. In addition, since the semi-bearing comprises metal, operation of the hydrostatic semi-bearing must be constantly and carefully monitored, because if the liquid film breaks down, then metal is on metal, which can damage the workpiece.

The object of the invention is therefore to create a method of the type cited in the foregoing that makes it possible to use CBN grinding wheels and that also enables substantially reduced processing times while still leading to rollers that have higher dimensional stability and surface quality.

SUMMARY OF THE INVENTION

This object is achieved by a method in which during grinding at least one cushioned body 15, 23, 26, 34, 39, 40, 41 made of an elastic solid material or an elastic exterior skin filled with an elastic pressure material is positioned in the circumferential region opposite the grinding wheel 13 against the roller 6 to be ground.

In that the cushioned body is positioned in the circumferential region opposite the grinding wheel against the roller to be ground, the transverse vibrations of the roller and even to an extent the vibrations deriving from the grinding wheel are successfully damped. The regenerative chattering does not occur, and thus there are no longer any feared chatter marks. That is, in contrast to the rests or supports comprising steel, the cushioned body does not lead to any tracks that result in reduced surface quality and are immediately recognizable to one skilled in the art. Prescribing the circumferential region opposite the grinding wheel means that the cushioned body is to be positioned approximately radially opposite the grinding wheel on the other side of the roller. However, this prescription should not be interpreted to be strict in geometric terms, because it is possible to successfully reduce vibrations even when the location at which the cushioned body is positioned against the roller is differs radially and axially relative from the grinding wheel in a certain area. The inventive method makes possible a substantial reduction in the grinding process, which can be up to a 50 percent reduction compared to the known method. Using the cushioned body is successful in both plunge-cut grinding and in longitudinal grinding.

However, it is preferred to perform the inventive method as longitudinal grinding, whereby the rotating grinding wheel 13 and the rotating roller 6 are moved relative to one another in the longitudinal direction of the roller 6 against its exterior circumference. For this, the roller, which is borne in centers and driven to rotate by means of these or using a carrier, can be passed on a grinding table against the rotating grinding wheel. However, the reverse arrangement is also conceivable. The continuously running longitudinal grinding works better in an automated procedure than plunge-cut grinding, which must be done in steps; in addition, there is no problem with tracks at the transition points.

Using the inventive method, the disadvantageous occurrence of vibrations is successfully suppressed such that it is possible to process by means of CBN grinding wheels. One particularly advantageous embodiment of the inventive method is comprised in that the roller 6 is rough-ground and finish-ground successively in a single instance of chucking, each with a ceramic-bound CBN grinding wheel 12,13 and the cushioned body is used at least during re-grinding.

DETAILED DESCRIPTION OF THE INVENTION

The following advantageous embodiments of the inventive method are related to how the cushioned body—hereinafter collectively referred to as flexible cushion—is positioned against the roller and moved in relation to it.

Thus, it has proved advantageous that the cushion 15 is positioned elastically flexible against the roller 6. In the simplest case, this can occur using a linear guide with a positioning set spring, the tension of which is adjustable. Preferably, however, it is positioned using a pressure medium, but electronically controlled positioning using electromotors is also conceivable.

There are broad options for applications and the positioning force with which the flexible cushion 15 is positioned against the roller 6 is adjustable and can even equal a value of 0 prior to the beginning of the grinding process. Positioning of the at least one flexible cushion occurs because the roller bends outward in the direction of cushion under the influence of the processing forces of the grinding wheel.

In terms of operations technology, pneumatically positioning the flexible cushion 15 against the roller 6 results in particularly good control of the positioning force.

The inventive method is most simple to perform in accordance with one additional embodiment in that at least one flexible cushion is positioned during grinding at a location that remains the same in the longitudinal extension of the roller. If, for example, the roller is borne between centers and the grinding wheel is passed at the exterior circumference of the roller in its longitudinal direction, the flexible cushion will preferably be arranged largely in the axial center of the roller because this is where the strongest transverse vibrations occur.

Even better adapted vibration damping occurs in that the at least one flexible cushion 15 and the roller 6 are moved relative to one another parallel to the longitudinal direction of the roller 6 during the grinding process. If the flexible cushion 15 is moved radially opposite the grinding wheel 13 with this relative to the roller 6, the cushion is always situated opposite the grinding wheel and thus at the location where the vibrations are excited. In this manner a particularly effective abatement in the vibrations can be achieved.

The further developments cited in the following relate to the embodiment of the cushion and to the associated addition of a lubricant/coolant to the region in which the flexible cushion is positioned against the roller.

It is thus advantageous for example when the flexible cushion 15, 23, 26, 34 conforms to the cylindrical contour of the roller 6 when positioned against it. This conforming can occur particularly advantageously in that a pressure medium, in particular a gas, acts on the exterior skin of the cushion 23, 26, 34 positioned against the roller 6 to be ground. In this manner the cushion is inflated like a balloon that gently conforms to an obstacle.

Because of the friction that occurs between the exterior skin of the cushion and the roller, it is advantageous when a liquid or gaseous lubricant is fed to the location at which the flexible cushion 23, 26, 34 is positioned against the roller 6. The method associated with this is particularly easy to construct in that the lubricant is formed by the pressure medium of the cushion 34 and fed to the location through apertures 35 that are situated in the exterior skin of the cushion 34 facing the roller 6.

Additional embodiments relate to how the inventive grinding method is controlled in detail.

Thus, a certain longitudinal contour of the roller can be attained during grinding in that the flexible cushion is adjusted transverse to the roller such that the roller bends outward during the grinding process and due to the grinding in its final state the roller has a longitudinal contour with a slightly concave or convex curve. During the grinding the roller takes on a certain bending without transverse vibrations occurring. When the flexible cushion is a certain distance from the exterior circumference of the roller while the roller is at rest, the roller will bend outward under the influence of the grinding wheel until it comes into contact with the cushion. However, it is also possible to set a pre-tension, whereby the roller is then pre-curved in the direction of the grinding wheel. When the grinding process is appropriately controlled, the result is rollers with an axial longitudinal contour that is curved concavely or convexly in the desired manner.

If the grinding wheel migrates in the axial direction relative to the roller to be ground, the resultant transverse vibrations also change depending on the axial region of the roller in which the grinding wheel is situated. Therefore, for fine-tuning the grinding process it is advantageous when the positioning force of the at least one flexible cushion is changed during the grinding process and/or is adjusted to different values for a plurality of cushions 39, 40, 41. The change in the positioning force will occur depending on the axial region of the roller on which the grinding wheel and/or the cushion are acting at that moment. The required values can be determined quickly using calculations or practical trials.

The invention also relates to an apparatus for external grinding of rollers, in particular for performing the inventive method. Inventively provided, therefore, is an apparatus for external grinding of rollers 6, in particular for performing the method of the invention, with tension and drive members for chucking the roller 6 at its end faces and for rotationally driving the roller 6 with at least one grinding spindle 11, driving a grinding wheel 13, that can be driven in a direction running transverse to the longitudinal axis of the roller 6 so that the grinding wheel 13 can be positioned against the roller 6, with drives for mutual longitudinal displacement of roller 6 and grinding wheel 13, and with at least one device 14 that is situated in a circumferential region of the roller 6 opposite the grinding wheel 13, through which device a cushioned body 15, 23, 26, 34, 39, 40, 41 made of an elastic solid material or an elastic exterior skin filled with an elastic pressure medium can likewise be positioned transverse to the longitudinal direction of the roller 6 against its circumference.

The device for positioning the cushioned body (of the flexible cushion) can for instance be present on the machine bed or on a grinding table that also carries the roller to be ground. It can be positioned mechanically, electrically, or by a pressure medium.

The following embodiments are related to how the positioning force can be applied advantageously and usefully in terms of structure and level. Thus, for controlling a high-grade grinding process it is essential that a control arrangement is present for setting the positioning force with which the flexible cushion 15 is positioned against the circumference of the roller 6 to be ground.

If a plurality of flexible cushions 39, 40, 41 are arranged along the roller 6 to be ground, it is advantageous that the positioning force of each cushion 39, 40, 41 can be adjusted individually and independent of the other cushions.

Particularly good control options result when the device for positioning the flexible cushion 15 includes a double-acting pneumatic sliding cylinder 17 at the piston rod 19 of which the cushion 15 is attached. If there are a plurality of flexible cushions 39, 40, 41 arranged along the roller 6 to be ground, each pneumatic sliding cylinder is allocated a discrete pressure regulator 44, 45, 46. In this manner perfect pneumatic control is ensured with which the vibrations are successfully damped at a plurality of locations on the axial extension of the roller.

Particular attention should be paid to the design of the cushion. The simplest solution is for the flexible cushion 15 to be formed by a body made of an elastic solid material. A high-quality plastic foam with closed cells and having or provided with an abrasion-resistant surface can accomplish this task well. It will to a certain extent conform to the exterior contour of the roller and in this manner successfully dampen the vibrations.

Additional advantages can be obtained when the flexible cushion 23 is formed by a hollow body made of an elastic exterior skin in which a pressure medium is located. This pressure medium can be a gas, preferably compressed air. A hollow body that is under pressure is particularly well-suited for conforming to the exterior contour of the roller, whereby the effect can even be controlled in that the internal pressure is optimally set as a function of the grinding process to be performed.

Precisely because such cushions conform well to be exterior contour of the roller, significant friction occurs between the flexible cushion and the roller. In order to reduce this friction, it is necessary for a lubricant/coolant to be fed to the location. For this purpose in accordance with one advantageous embodiment feed lines are provided that open in the region of the location where the flexible cushion is positioned against the roller through which a lubricant is fed to this location. The grinding emulsions, synthetic coolant lubricants, and grinding oils conventionally used in abrasive engineering are appropriate as lubricants. However, compressed air can also be used. If the feed lines conducting the lubricant pass through the flexible cushion directly to the location where the cushion is positioned against the roller, the lubricant is located at precisely the location where it can have its greatest effect. In the case of a liquid lubricant, a film forms between the roller and the flexible cushion, just as in aqua-planing in an automobile tire, and is particularly effective. If lubrication is performed with compressed air, an air cushion can form, as is known from air cushion vehicles. It must be stressed that the lubricant film or the air cushion effectively reduces friction losses during grinding without this reducing the effectiveness of the vibration damping.

One particularly effective solution in terms of design is that the feed lines that pass through the flexible cushion 26 and forward lubricant are embodied as tubes 30 that are integral with the elastic external skin of the cushion 26, whereby the lubricant and the pressure medium are separated from one another.

However, if the pressure medium of the cushion is itself used as coolant, it is particularly simple in terms of design that the elastic exterior skin of the flexible cushion 34 is provided at its positioning surface facing the roller 6 to be ground with a plurality of apertures through which the pressure medium passes to the positioning location to form the cooling and lubricating film at this location. Thus, in this embodiment pressure medium must pass continuously from the flexible cushion outward to the positioning location. It is necessary to feed the pressure medium continuously, and this can be done with no problem using pressure regulators. This solution can be even further perfected in that the pneumatic control of the sliding cylinder, at the piston rod of which the flexible cushion is situated, is included in the process.

For performing the two-stage grinding process mentioned in method claim 3 with positioning of the flexible cushions 6 against the roller or, at least during re-grinding, in terms of the apparatus design it is advantageously provided that a grinding headstock 8 is provided with two grinding spindles 10, 11 that can be selectively brought into the work position and of which the first 10 carries a ceramic-bound CBN grinding wheel 12 for rough-grinding and the second carries a ceramic-bound CBN grinding wheel 13 for finish-grinding, whereby an automatic coupling is provided through which the at least one device for positioning the flexible cushion 15 against the wheel 6 to be ground is activated when the second grinding wheel 11 is brought into the work position. In this manner the inventive apparatus is prepared for automating, which is highly desirable on production lines in modern mass production.

The invention will be explained in greater detail using exemplary embodiments that are illustrated in the figures.

Figure 4:
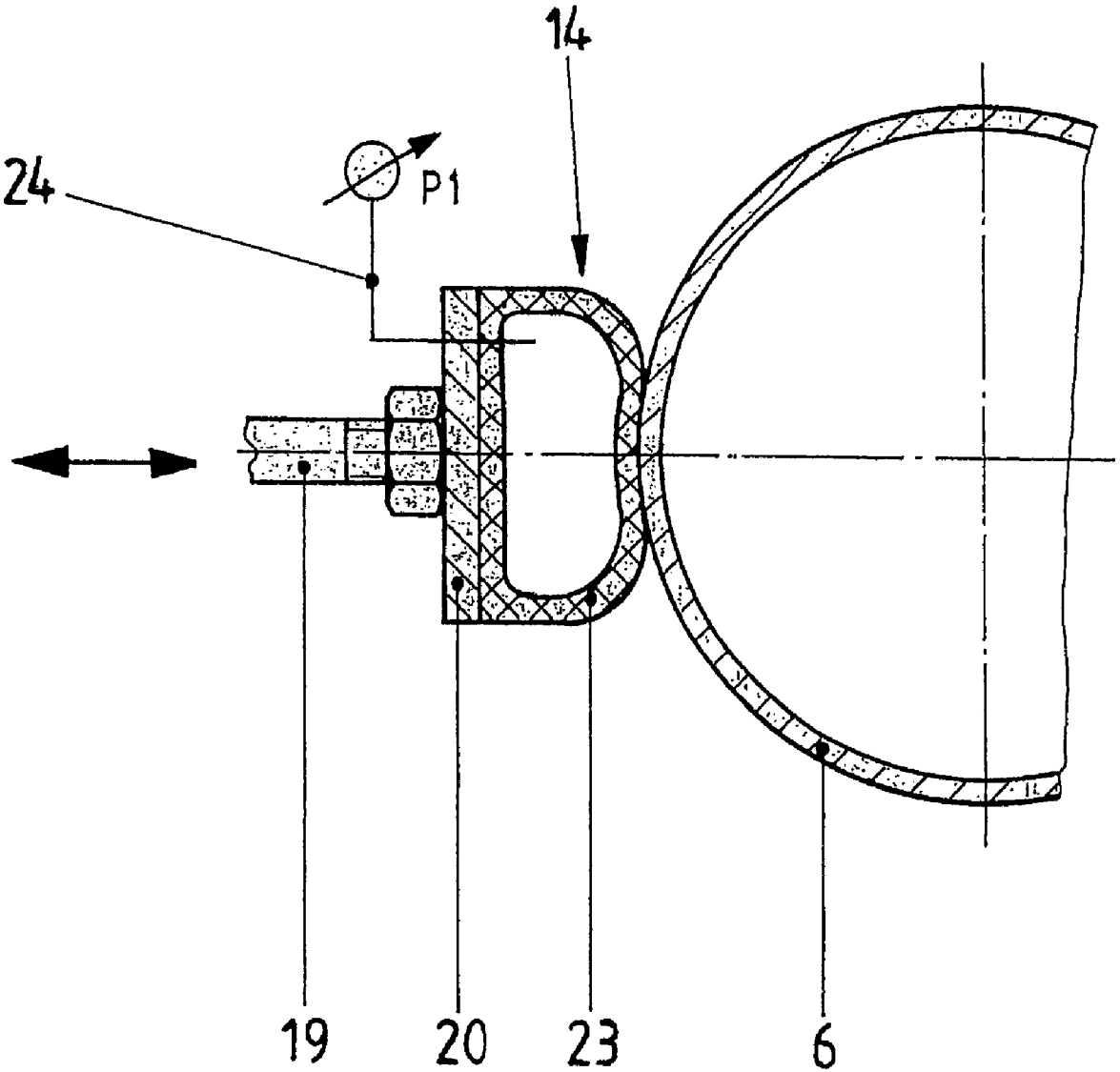

The subject of FIG. 4 is another design of the flexible cushion.

Figure 5:
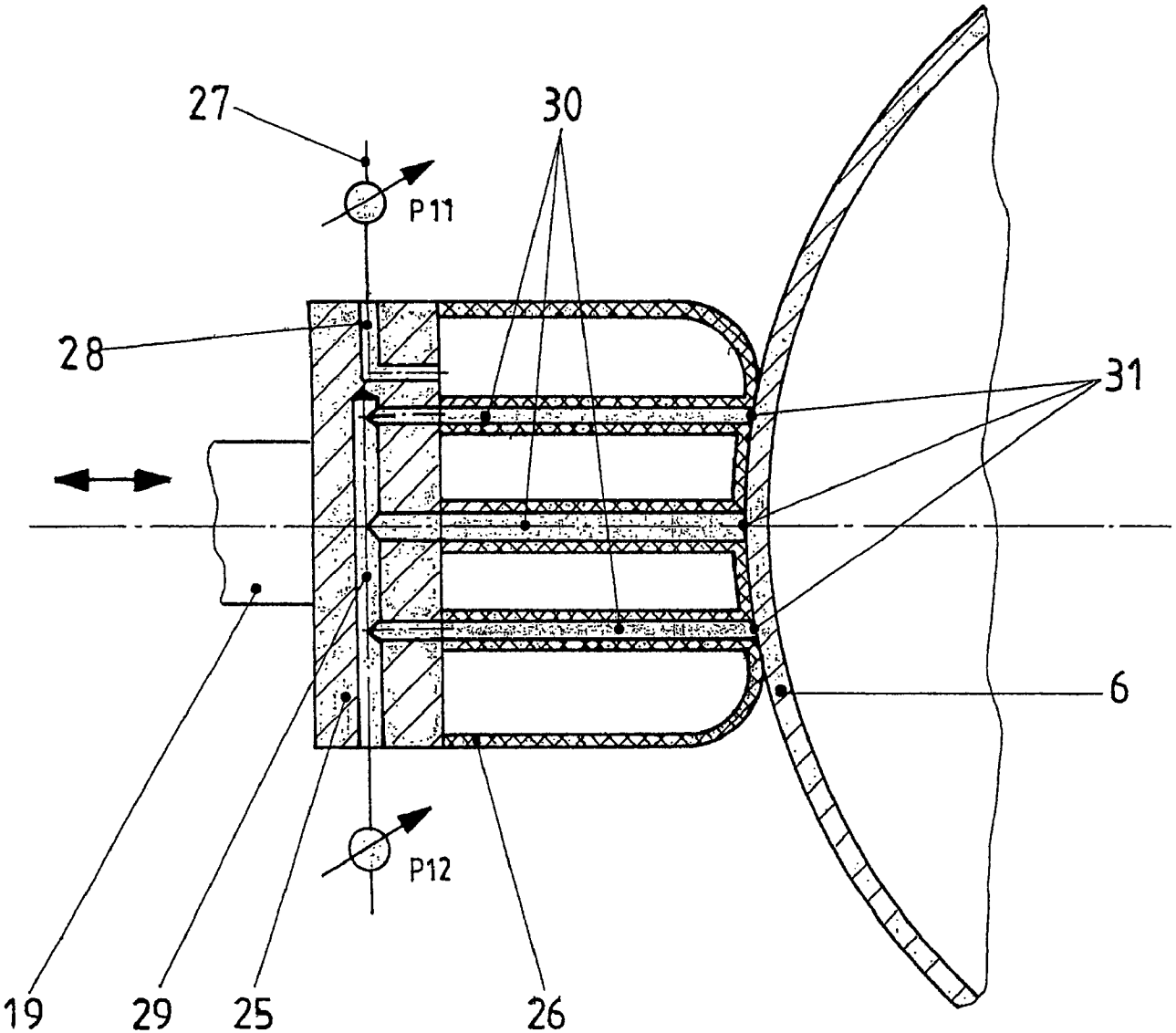

FIG. 5 illustrates the feed of a lubricant in the region of the flexible cushion.

Figure 6:
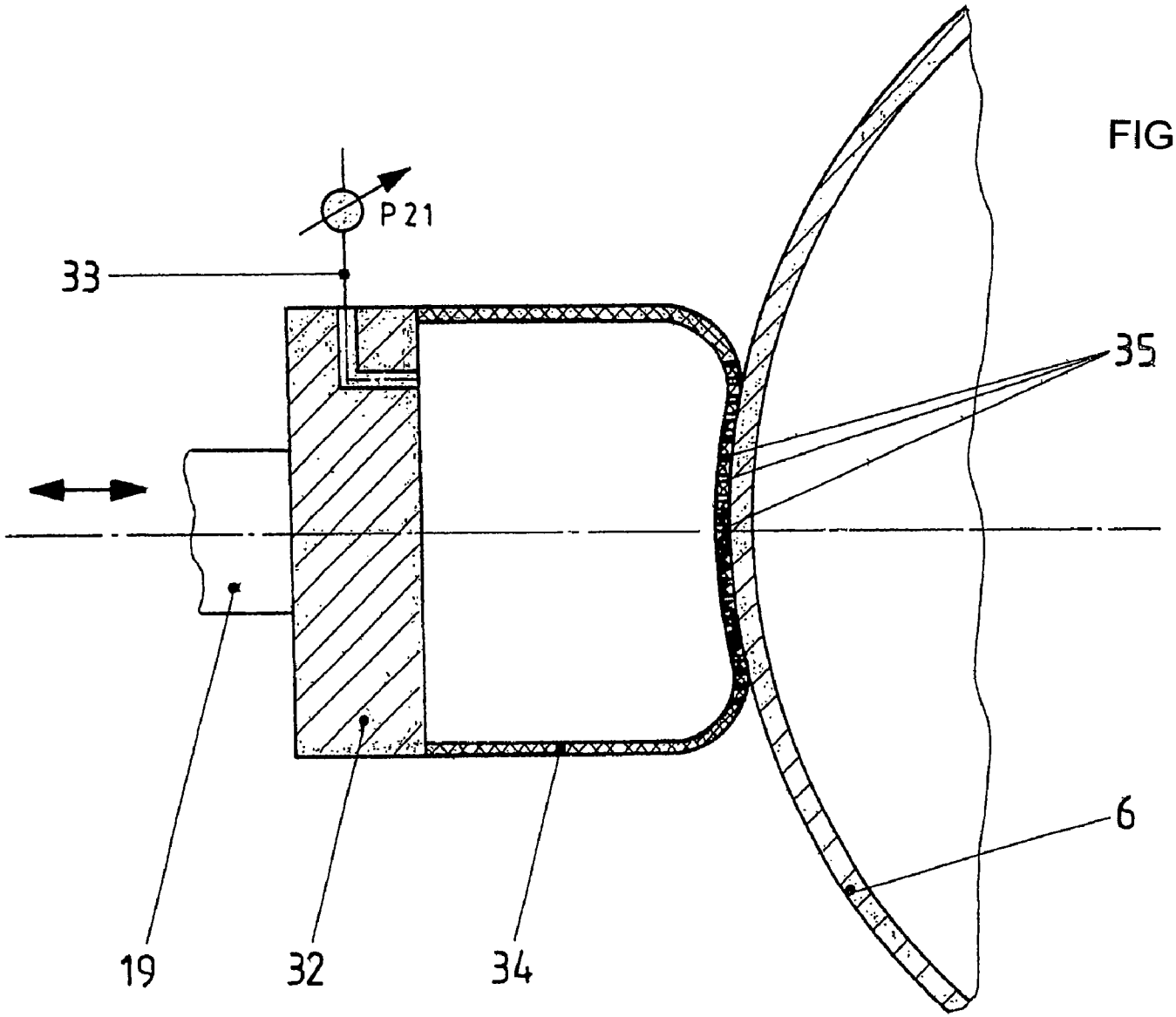

FIG. 6 illustrates a flexible cushion, the pressure medium of which is also a lubricant.

Figure 7:
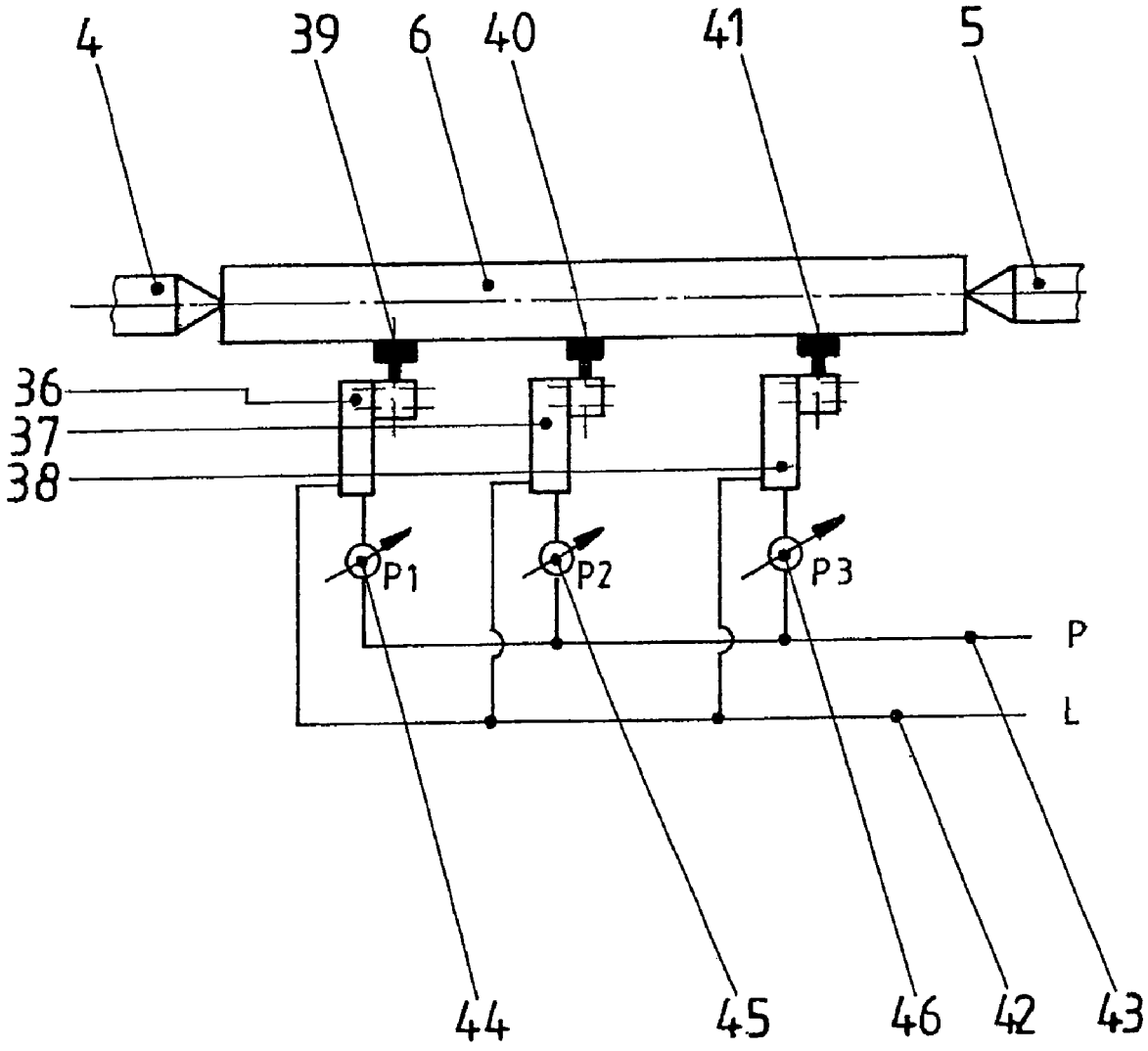

FIG. 7 contains a scheme that illustrates the control of a plurality of devices for positioning elastic cushions against the various axially distanced locations of the roller.

Figure 1:
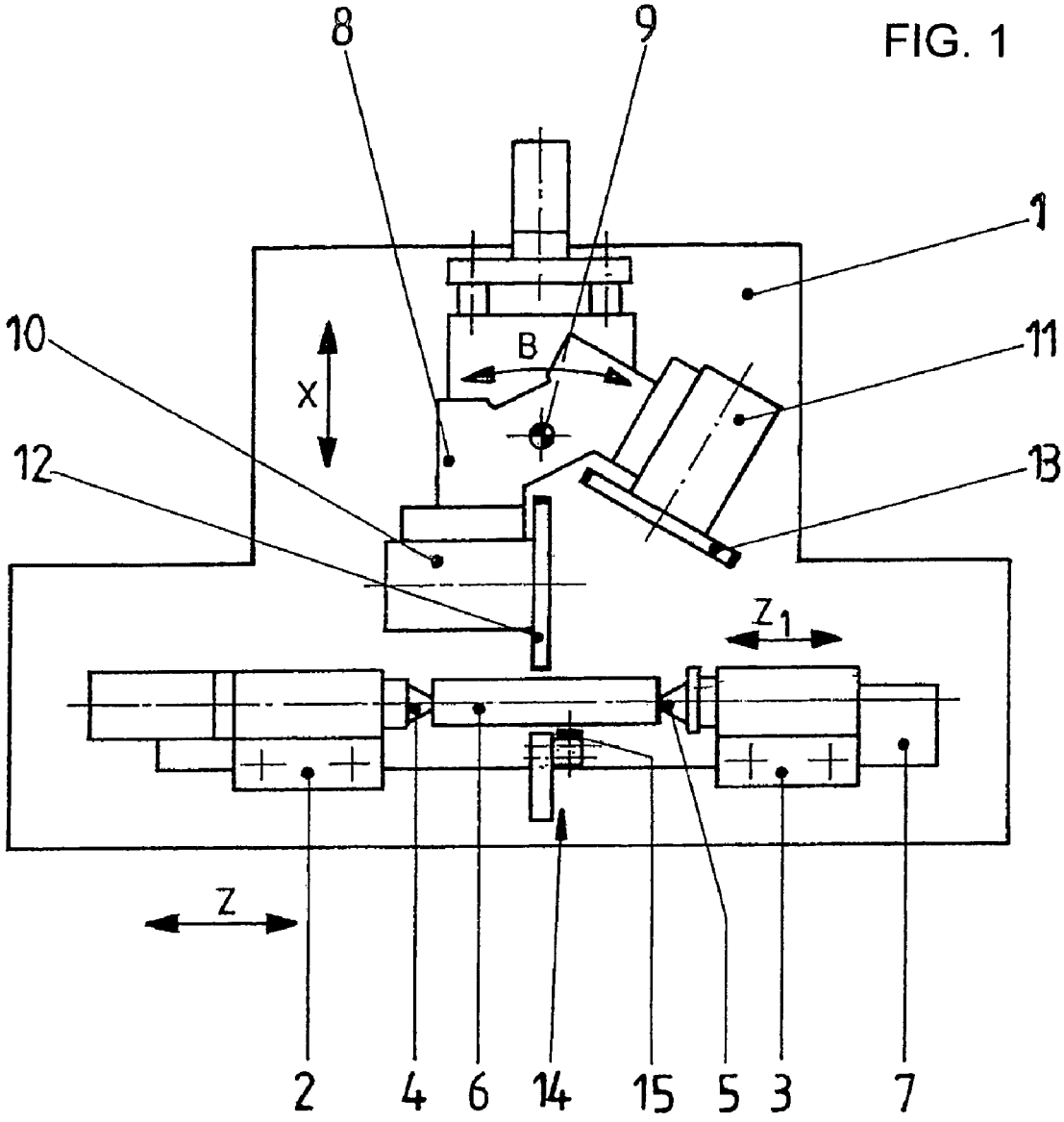
FIG. 1 illustrates an apparatus for performing the inventive method, whereby the rough-grinding phase is depicted.

FIG. 1 illustrates in a schematic representation a conventional circular grinding machine for external grinding of cylindrical parts. In a view from above a machine bed 1 can be seen on which are located a workpiece headstock 2 and a tailstock 3. Workpiece headstock 2 and tailstock 3 are mutually adjustable in the axial direction so that the roller 6 to be ground can be chucked and driven to rotation by means of the centers 4 and 5 located on them. However, the roller can also be driven by carriers that are conventional in the art and are therefore not shown separately here. The workpiece headstock 2 and the tailstock 3 are located on a grinding table 7 that can be moved as a whole in the Z direction.

Furthermore, located on the machine bed 1 is a grinding headstock 8 that is adjustable about a vertical pivot axis 9. The grinding headstock carries a first grinding spindle 10 and a second grinding spindle 11. Of these, the first grinding spindle 10 carries the first grinding wheel 12 that rough-grinds or rough-cuts, while the second grinding spindle 11 carries a second grinding wheel 13 intended for finish-grinding or finish-cutting.

By pivoting about the vertical pivot axis 9, the grinding headstock 8 moves in the direction of the arrow B so that the grinding wheel 12 (FIG. 1) or the second grinding wheel 13 (FIG. 2) can be selectively brought into the working position. In addition, the entire grinding headstock 8 can be driven in the X direction numerically controlled, whereupon the grinding wheel currently in the working position comes to be positioned against the roller 6 to be ground in a controlled manner.

As can be seen, the axial length of the roller 6 to be ground is a multiple of the grinding wheel width so that for grinding using so-called longitudinal grinding the grinding wheel and the roller to be ground must be moved past one another in the axial direction. For this, the roller 6 located on the grinding slide can be moved past the grinding wheel. However, the reverse arrangement is also possible in that the roller to be ground is fixed in the axial direction, while the grinding headstock is moved past it.

Labeled 14 is a device for vibration damping; it can be used to position a flexible cushion 15 against the roller in a controlled manner. FIG. 1 illustrates the device 14 in its non-working position; the flexible cushion 14 is situated at a distance from the surface of the roller to be ground. In contrast, in the illustration in accordance with FIG. 2 the flexible cushion 15 is positioned against the roller. It is situated opposite the grinding wheel 13 in the radial direction. If the grinding wheel acts on the roller 6, it will bend outward laterally and have a tendency for transverse vibrations, especially if the length/diameter ratio is greater than that illustrated in the drawing. Tube shaped rollers with low material strength are also particularly susceptible to this type of vibration. Since the flexible cushion 15 is now positioned against the roller with moderate adjustable pressure, the transverse vibrations are damped and suppressed so that the "regenerative chattering" feared by those skilled in the art does not occur. This also prevents the chatter marks that betray roller surface quality in the ground roller.

Figure 2:
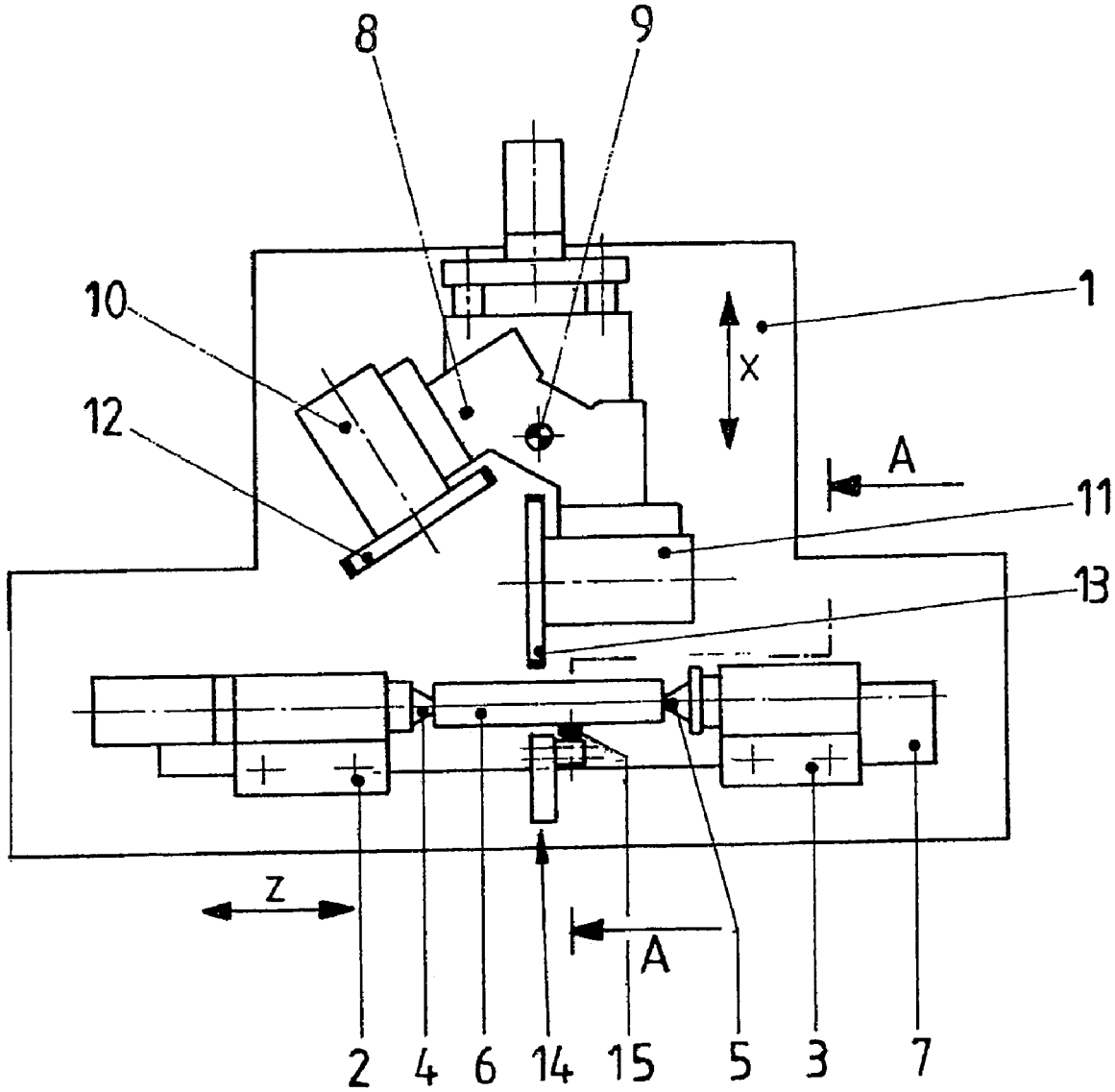
FIG. 2 depicts the apparatus in accordance with FIG. 1 in the finish-grinding phase.

In the illustrations in accordance with FIGS. 1 and 2, the device 14 is situated precisely opposite the grinding wheels 12 or 13. However, if the roller 6 to be ground is caused by means of the grinding table 7 to pass the grinding wheel in the axial direction, the position of the device 14 also changes relative to that of the grinding wheel. It is therefore advantageous when a plurality of devices with different flexible cushions is provided across the axial extension of the roller 6 to be ground as FIG. 7 illustrates in greater detail.

However, it is also conceivable to arrange the device 14 on the machine bed so that it always remains precisely opposite the grinding wheel that is in the working position. Finally, a solution is also conceivable in which only one device 14 is provided, but it is moved axially with the grinding spindle opposite the roller to be ground so that the mutual allocation of grinding wheel and device 14 is retained in every case.

FIGS. 1 and 2 also illustrate a method particularly preferred in accordance with the invention in which the rough-grinding is performed by means of a ceramic-bound CBN grinding wheel and the device 14 for damping the vibrations does not operate. However, if the grinding wheel 13 is brought into the working position for finish-grinding, this is automatically coupled to activation of the device 14 as illustrated in FIG. 2. Thus, transverse vibrations are effectively suppressed during finish-grinding or finish-cutting so that optimum surface qualities are obtained despite a short processing time.

Figure 3:
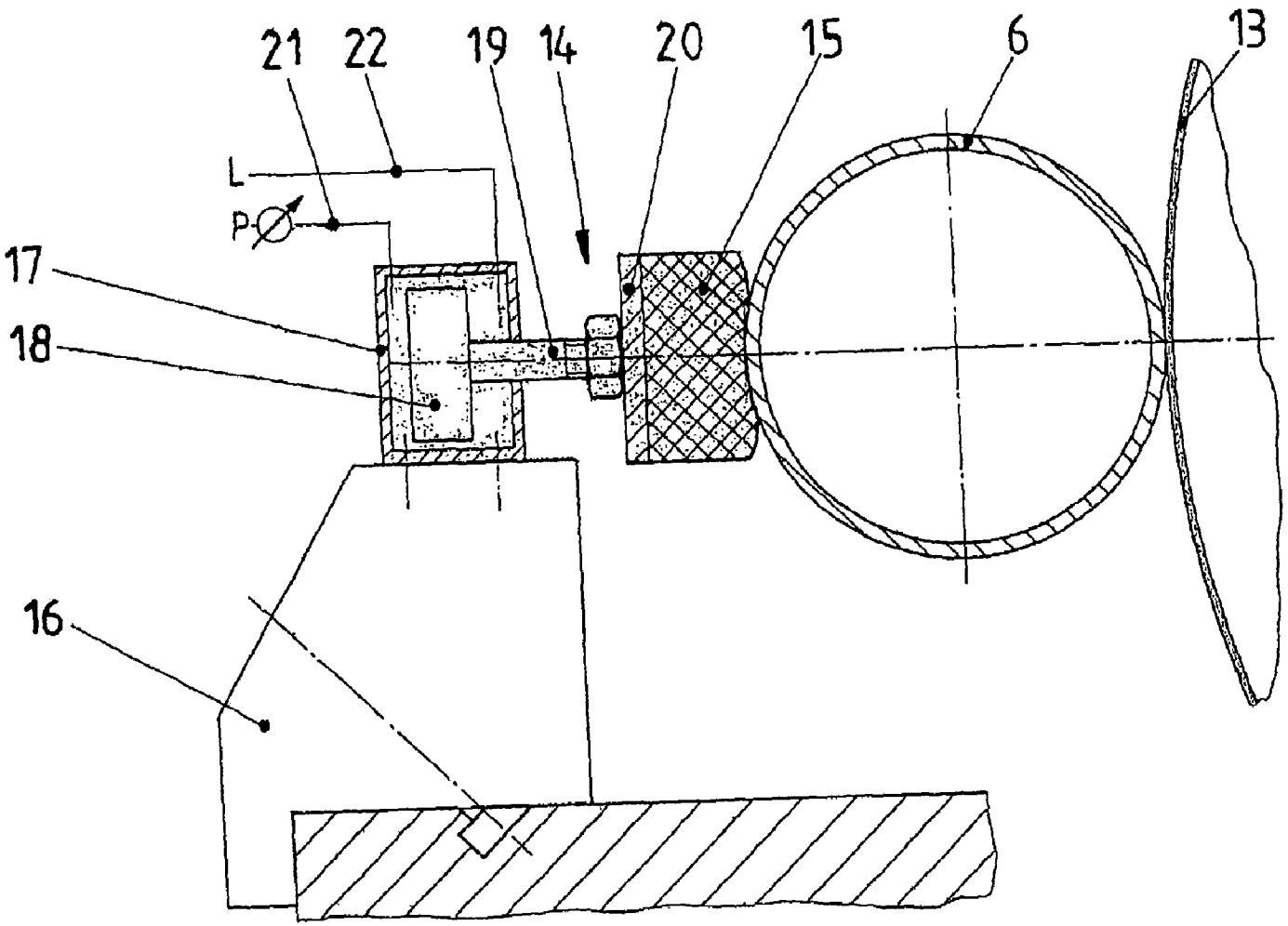
FIG. 3 is an enlarged view corresponding to direction A—A in accordance with FIG. 2 and illustrates details of the flexible cushion cooperating with the roller to be ground.

FIG. 3 illustrates the view A—A in accordance with FIG. 2 in an enlarged representation. It explains a device for vibration damping that is actuated pneumatically. For thus, a base 16 is provided that can be attached directly to the machine bed 1 or to the grinding table 7. The base 16 carries a pneumatic dual-acting sliding cylinder 17 in which a piston 18 can be acted upon from two sides. The piston 18 carries a piston rod 19 on which a fastening plate 20 is situated. The flexible cushion 15 is glued or vulcanized to the fastening plate 20. The cushion can comprise a rubber-like material or a plastic with closed hollow cells that is thus particularly flexible and conformable. What is critical is that although the exterior surface of the flexible cushion 15 is elastic, it is still resistive and resistant to wear 21 and 22 are compressed air lines through which the sliding cylinder is controlled. It can thus press the flexible cushion 15 against the roller 6 with precisely adjustable force. As can be seen, the roller 6, which in this case is a hollow roller, is acted upon on both sides between the grinding wheel 13 and the flexible cushion 15. The roller will thus yield slightly under the positioning force of the grinding wheel 13, whereby however transverse vibrations that occur are suppressed by the damping effect of the flexible cushion 15.

The starting position of the flexible cushion 15 is also adjustable prior to the beginning of the grinding process. For instance, the positioning force can be zero at the beginning so that the roller 6 is not pressed into the flexible cushion 15 until it is acted upon by the grinding wheel 13.

FIG. 4 illustrates a device 14 for damping vibrations in which the flexible cushion 23 is embodied as a hollow body with an elastic exterior skin, comparable to tires on automobiles. Compressed air for instance can be introduced into the interior of the flexible cushion 23 with a feed line 24, whereby different elasticity properties can be attained. However, it is also conceivable to fill the flexible cushion with a fluid when elastic yielding of the fluid is ensured. It can also be filled with a gel.

The other embodiments of the device 14 correspond to those in accordance with FIG. 4; in particular here as well the positioning of the flexible cushion 23 against the roller 6 must occur with a particular device such as for instance a sliding cylinder.

FIG. 5 also explains a flexible cushion 26, filled with a pressure medium, that here is situated on a fastening plate 25 and joined thereto. The fastening plate 25 is connected to a feed line 27 for the pressure medium, for which compressed air is primarily used. The pressure medium is introduced into the hollow space of the flexible cushion 26 via an internal channel 28 located in the attaching plate 25. Passing through the flexible cushion 26 are tubes 30 that are integral with the exterior skin of the cushion 26, but that do not communicate with the interior space of the cushion 26. The tubes 30 are connected to a channel system 29 that is located in the attaching plates 25 and through which a coolant/lubricant is applied by means of the tubes 30 directly to the surface of the flexible cushion 26 that is against the roller 6. For this, the tubes 30 end in apertures 31 that are directly oriented to the roller 6. As can be seen, the apertures 31 open at the surface of the roller 6 so that the coolant/lubricant travels precisely to the location at which it is most urgently needed.

P11 and P12 indicate pressure regulators that set the optimum operating pressure for the media.

When the pressure medium located in the hollow flexible cushions can be both coolant and lubricant, it is no longer necessary to have separate feed lines for the pressure medium of the cushion and for the coolant/lubricant. FIG. 6 illustrates this advantageous design.

In accordance with it, a flexible cushion 34 is again glued or vulcanized to a fastening plate 32, whereby a feed line 33 leads via a pressure regulator P21 into the interior of the flexible cushion 34. In this case the flexible cushion is provided at its end face that faces the roller 6 with a number of apertures 35. Thus the pressure medium of the cushion exits through the apertures 35 continuously in the direction of the surface of the roller 6. In this case pressure medium must be continuously fed into the flexible cushion 34 so that the required pressure is maintained.

FIGS. 4 through 6 illustrate how well the inflatable cushions conform to the contour of the roller. In the case of FIGS. 5 and 6 it is particularly ensured that the coolant/lubricant forms a film between the flexible cushion and the roller, comparable to the film of water during so-called aqua-planing or to an air cushion vehicle like a hovercraft. The embodiment in accordance with FIG. 6 is particularly advantageous when an air cushion is used.

FIG. 7 is a schematic illustration of how the devices for vibration damping should be controlled when a plurality of these devices is provided along the axial extension of the roller 6 to be ground. In the instance represented, three devices 36, 37, 38 are provided, of which each positions a flexible cushion 39, 40, 41 against the roller 6 to be ground. Positioning occurs pneumatically, for which reason each of the devices 36, 37, 38 has a sliding cylinder in accordance with FIG. 3. As can be seen, the vibration amplitudes in the center of the roller 6 chucked between the centers 4 and 5 will be greater than in the region of its exterior ends, which are situated closer to the chucking locations. It is therefore useful to select the positioning force of the device 37 higher than that of the devices 36 and 38. Correspondingly, a discrete pressure regulator 44, 45, 46 is provided in the compressed air line P for each of the devices 36, 37, 38 so that the sliding cylinder of each device can maintain the optimum pneumatic pressure for vibration damping. In addition, the compressed air lines P and return line L are embodied common for all devices.

1 Machine bed
2 Workpiece headstock
3 Tailstock
4 Center
5 Center
6 Roller
7 Grinding table
8 Grinding headstock
9 Pivot axis
10 First grinding spindle
11 Second grinding spindle
12 First grinding wheel
13 Second grinding wheel
14 Device for vibration damping
15 Flexible cushion
16 Base
17 Sliding cylinder
18 Piston
19 Piston rod
20 Attaching plate
21 Compressed air line
22 Compressed air line
23 Flexible cushion
24 Feed line
25 Attaching plate
26 Flexible cushion
27 Feed line
28 Internal channel
29 Channel system
30 Tube
31 Apertures
32 Attaching plate
33 Feed line
34 Flexible cushion
35 Apertures
36, 37, 38 Devices for vibration damping
39, 40, 41 Flexible cushion
42, 43 Control line
44, 45, 46 Pressure regulator

What is claimed is:

1. Method for grinding, with a rotating grinding wheel, an exterior circumference of a rotating cylindrical roller, held at ends thereof, length of said roller being greater than width of said grinding wheel, comprising: during grinding, positioning at least one deformable, cushioned body against, and conforming to a portion of the exterior circumference of the roller opposite a portion of the exterior circumference of the roller contacted by the grinding wheel, the cushioned body being comprised of an elastic solid material or an elastic exterior skin filled with an elastic pressure medium.

2. Method according to claim 1, wherein said rotating grinding wheel and said rotating roller are moved relative to one another in the longitudinal direction of said roller while said rotating grinding wheel is in contact with the exterior circumference of the rotating roller.

3. Method according to claim 1, wherein said grinding wheel is a ceramic bound CBN grinding wheel and said grinding comprises rough grinding followed by finish grinding with said holding of the roller at its ends being effected by a single chucking for both said grindings and said positioning of the cushioned body against the roller is at least during the finish grinding.

4. Method according to claim 1, wherein the positioning of the cushioned body against the roller is elastically flexible.

5. Method according to claim 1, wherein force applied to the roller by the cushioned body is adjustable.

6. Method according to claim 1, wherein the cushioned body is not positioned against the roller until grinding begins.

7. Method according to claim 1, wherein the positioning of cushioned body against the roller is carried out pneumatically.

8. Method according to claim 1, wherein the positioning of at least one of the cushioned bodies is fixed during the grinding.

9. Method according to claim 1, wherein at least one of said cushioned bodies and said roller are moved relative to one another parallel to a longitudinal direction of said roller during the grinding.

10. Method according to claim 9, wherein said at least one cushioned body is moved radially with respect to the roller.

11. Method according to claim 1, wherein the cushioned body is conformable to the roller when the cushioned body is positioned against the roller.

12. Method according to claim 11, wherein the cushioned body comprises the elastic exterior skin and the elastic pressure medium is a gas.

13. Method according to claim 1, further comprising feeding a liquid or gaseous lubricant to a location at which the cushioned body is positioned against the roller.

14. Method according to claim 13, wherein the lubricant comprises at least one of grinding emulsions, synthetic coolants and grinding oils.

15. Method according to claim 13, wherein the elastic pressure medium is the lubricant and the elastic exterior skin has apertures therethrough facing the roller and through which the lubricant flows.

16. Method according to claim 1, wherein the cushioned body is moved away from the roller transversely of the roller axis thereby to permit the roller to be bent during the grinding, whereby the roller is shaped with a slightly concave/convex longitudinal curvature.

17. Method according to claim 1, whereby force with which said at least one cushioned body is positioned against said roller is adjusted during the grinding.

18. Method according to claim 1, wherein a plurality of said cushioned bodies are positioned against said roller and force with which each of said cushioned bodies is positioned against said roller is individually adjusted.

19. Method according to claim 17 or 18, wherein said adjustments are dependent on the positions of the grinding wheel and/or said cushioned bodies along the axis of the roller.

20. Apparatus for grinding exterior circumference of a rotating cylindrical roller held at ends thereof, comprising: a rotating grinding wheel, length of said roller being greater than width of said grinding wheel, tension and drive members for chucking the roller at end faces of the roller and for rotationally driving the roller, a first grinding spindle, a first grinding wheel rotationally driven by the first grinding spindle, means for driving the grinding wheel in a direction transverse to a longitudinal axis of the roller so that the grinding wheel is positionable against the roller, means for driving at least one of the roller and the grinding wheel for relative displacement thereof in directions parallel to the length of the roller, at least one deformable, cushioned body comprising an elastic solid material or an elastic exterior skin filled with an elastic pressure medium, and means for positioning said at least one cushioned body against and conforming to a first portion of the exterior circumference of the roller opposite a second portion of the exterior circumference of the roller contacted by the grinding wheel.

21. Apparatus according to claim 20, further comprising a control for setting force with which said at least one cushioned body is positioned against the roller.

22. Apparatus according to claim 21, wherein the control is for individually setting force with which each of said at least one cushioned bodies are positioned against the roller.

23. Apparatus according to claim 20, wherein said means for positioning said at least one cushioned body comprises at least one double-acting pneumatic cylinder including a piston rod to which said at least one cushioned body is attached.

24. Apparatus according to claim 23, wherein said at least one cushioned body comprises a plurality of said cushioned bodies and said at least one double-acting pneumatic cylinder comprises a plurality of said double-acting cylinders and said control comprises a plurality of discrete pressure regulators, each of said pressure regulators being operatively connected to a respective one of said cylinders.

25. Apparatus according to claim 20, wherein said cushion comprises said elastic exterior skin and said elastic pressure medium comprises compressed air.

26. Apparatus according to claim 20, further comprising feed lines for lubricant, the feed lines opening at a location approximately where the cushioned body is positioned against the roller.

27. Apparatus according to claim 26, wherein the feed lines pass through said at least one cushioned body directly to said location.

28. Apparatus according to claim 27, wherein said cushion comprises said elastic exterior skin and said feed lines are integral with said skin, whereby said lubricant is separated from said elastic pressure medium.

29. Apparatus according to claim 25, wherein said elastic exterior skin has apertures at a location approximately where the cushioned body is positioned against the roller and the compressed air discharges through said apertures thereby to function as a lubricant.

30. Apparatus according to claim 20, further comprising a second grinding spindle, a grinding headstock supporting said first and second grinding spindles and wherein the first grinding wheel is a CBN grinding wheel for rough grinding, and the apparatus also comprising a second CBN grinding wheel for finish grinding, the second grinding wheel being rotationally driven by the second grinding spindle, and an automatic coupling for activating the means for positioning the cushioned body against said first portion of the exterior circumference of the roller when said second grinding wheel is brought into a work position to grind the roller.

* * * * *